US009069293B2

(12) United States Patent
Fujihara

(10) Patent No.: US 9,069,293 B2
(45) Date of Patent: Jun. 30, 2015

(54) DEVELOPING DEVICE, IMAGE FORMING APPARATUS, AND CONTROL METHOD OF DEVELOPING DEVICE

(71) Applicant: KYOCERA Document Solutions Inc., Osaka (JP)

(72) Inventor: Kensuke Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/257,761

(22) Filed: Apr. 21, 2014

(65) Prior Publication Data

US 2014/0321869 A1 Oct. 30, 2014

(30) Foreign Application Priority Data

Apr. 26, 2013 (JP) ..... 2013-094171

(51) Int. Cl.
*G03G 15/08* (2006.01)
*G03G 15/09* (2006.01)
*G03G 15/06* (2006.01)

(52) U.S. Cl.
CPC .... *G03G 15/0907* (2013.01); *G03G 2215/0634* (2013.01); *G03G 15/0808* (2013.01); *G03G 15/0806* (2013.01); *G03G 15/065* (2013.01)

(58) Field of Classification Search
CPC ..... G03G 15/08
USPC ..... 399/55
See application file for complete search history.

(56) References Cited

U.S. PATENT DOCUMENTS

| | | | | |
|---|---|---|---|---|
| 4,872,100 | A * | 10/1989 | Diaz | 363/41 |
| 6,282,385 | B1 * | 8/2001 | Suto | 399/55 |
| 6,917,780 | B2 * | 7/2005 | Ozawa et al. | 399/282 |
| 6,959,163 | B2 * | 10/2005 | Nishiyama | 399/269 |
| 7,167,667 | B2 * | 1/2007 | Mabuchi | 399/255 |
| 7,742,727 | B2 * | 6/2010 | Sakata et al. | 399/270 |
| 7,787,807 | B2 * | 8/2010 | Nakaue et al. | 399/277 |
| 7,848,686 | B2 * | 12/2010 | Inoue et al. | 399/272 |
| 7,877,030 | B2 * | 1/2011 | Horie et al. | 399/55 |
| 7,937,008 | B2 * | 5/2011 | Fujishima et al. | 399/49 |
| 7,941,080 | B2 * | 5/2011 | Sakata et al. | 399/270 |
| 7,979,011 | B2 * | 7/2011 | Fujihara et al. | 399/270 |
| 8,116,647 | B2 * | 2/2012 | Fujihara et al. | 399/55 |
| 8,478,150 | B2 * | 7/2013 | Fujihara et al. | 399/55 |
| 8,873,980 | B2 * | 10/2014 | Fujihara et al. | 399/55 |

(Continued)

FOREIGN PATENT DOCUMENTS

| | | | | |
|---|---|---|---|---|
| JP | 2006-221107 | * | 8/2006 | G03G 15/08 |
| JP | 2006-221107 | A | 8/2006 | |

*Primary Examiner* — Clayton E Laballe
*Assistant Examiner* — Kevin Butler
(74) *Attorney, Agent, or Firm* — Stein IP, LLC

(57) ABSTRACT

A developing device includes a developing roller, a magnetic roller opposed to the developing roller so as to form a magnetic brush, a high voltage power supply including a transformer having secondary side outputs one of which is connected to the developing roller while the other output is connected to the magnetic roller, so as to apply AC voltages to the developing roller and the magnetic roller, a detection portion for detecting occurrence of discharge between the developing roller and the photoreceptor drum, a restriction portion for restricting movement of toner from the magnetic roller to the developing roller, and a moving portion configured to move the restriction portion in discharge start voltage detection mode so as to restrict toner movement to the developing roller.

15 Claims, 10 Drawing Sheets

(56) References Cited

U.S. PATENT DOCUMENTS

| | | | | |
|---|---|---|---|---|
| 2003/0049054 | A1* | 3/2003 | Ozawa et al. | 399/272 |
| 2008/0232862 | A1* | 9/2008 | Fujishima et al. | 399/285 |
| 2009/0028593 | A1* | 1/2009 | Okumura | 399/55 |
| 2010/0111551 | A1* | 5/2010 | Fujihara et al. | 399/55 |
| 2010/0129102 | A1* | 5/2010 | Fujihara et al. | 399/55 |
| 2010/0195150 | A1* | 8/2010 | Takahashi et al. | 358/1.15 |
| 2013/0156454 | A1* | 6/2013 | Fujihara et al. | 399/55 |
| 2013/0183053 | A1* | 7/2013 | Nakagawa et al. | 399/55 |
| 2013/0259504 | A1* | 10/2013 | Fujihara | 399/55 |
| 2013/0287415 | A1* | 10/2013 | Nakagawa | 399/44 |

* cited by examiner

DEVELOPING DEVICE, IMAGE FORMING APPARATUS, AND CONTROL METHOD OF DEVELOPING DEVICE

CROSS-REFERENCE TO RELATED APPLICATIONS

This application is based upon and claims the benefit of priority from the corresponding Japanese Patent Application No. 2013-094171, filed Apr. 26, 2013, in the Japanese Patent Office. All disclosures of the document(s) named above are incorporated herein by reference.

BACKGROUND OF THE INVENTION

The present disclosure relates to a developing device configured to perform developing of an electrostatic latent image using toner and to an image forming apparatus including the developing device.

There is an image forming apparatus such as a multifunction peripheral, a copier, a printer, a facsimile, or the like, which develops an electrostatic latent image with toner so as to perform printing. Further, there is an image forming apparatus that uses a developer containing magnetic carrier and toner (so-called two-component developer). It is not appropriate to permit a magnetic brush to directly contact with a photoreceptor drum in view of image quality and the like. Therefore, the applicant has provided an image forming apparatus including a developing device using a method in which a developing roller is disposed to be opposed to the photoreceptor drum so as to carry toner, a magnetic roller opposed to the developing roller forms a magnetic brush, only the toner is moved to the developing roller by the magnetic brush so as to form a thin layer of the toner on the developing roller, and hence an electrostatic latent image is developed without permitting the magnetic brush to contact with the photoreceptor drum (this method is also referred to as "touchdown development" or "hybrid development"). This method is more advantageous in various points such as image quality, print speed, toner life, prevention of carrier scattering, than a one-component development method or the conventional two-component development method.

In the touchdown development method described above, when performing the development of an electrostatic latent image, an AC voltage (for example, approximately 1 to 2 kV as peak-peak voltage) is applied to the developing roller so that charged toner is caused to fly. As the peak-peak voltage of the AC voltage applied to the developing roller is larger, the toner can fly more sufficiently so that density of the developed toner image is apt to be higher and that the electrostatic latent image can be developed more efficiently.

However, when the peak-peak voltage of the AC voltage applied to the developing roller is becomes too high, discharge occurs between the developing roller and the photoreceptor drum. When discharge occurs, a surface potential of the photoreceptor drum is disturbed, and hence image quality may be deteriorated. In addition, when the discharge is large, a micro hole may be formed on the photoreceptor drum so that the photoreceptor drum may be damaged.

Therefore, there is a case where a discharge start voltage (peak-peak voltage at which discharge starts) is detected as for the AC voltage applied to the developing roller. In other words, there is a case where a potential difference between the photoreceptor drum and the developing roller at which discharge starts is detected. In the detection of the discharge start voltage, it is detected that current flows in the developing roller or the photoreceptor drum so as to determine whether or not discharge has occurred.

Here, because the toner is charged, when the toner moves (flies) from the developing roller to the photoreceptor drum, the charge is moved. Because of this movement of toner, it may be falsely detected that discharge has occurred. Therefore, it is preferred not to supply toner to the developing roller during a discharge start voltage detection mode, so that the developing roller does not carry the toner.

On the other hand, the AC voltages to be applied to the developing roller and the magnetic roller (for supplying toner to the developing roller) may be generated by a transformer. Further, in order to simplify the circuit and to reduce manufacturing cost, the voltage to be applied to the developing roller and the voltage to be applied to the magnetic roller may be generated on a secondary side of the same transformer. In other words, a transformer having two or more secondary windings may be used.

Using this transformer, it is impossible to apply AC voltage only to the developing roller. When AC voltage is applied to the developing roller, AC voltage is also applied to the magnetic roller. Therefore, when AC voltage is applied to the developing roller in the discharge start voltage detection mode, AC voltage is also applied to the magnetic roller, and hence the toner moves from the magnetic roller to the developing roller.

Then, there is a problem that when using a transformer having two or more secondary windings, the toner is supplied to the developing roller in the discharge start voltage detection mode. In addition, there is a problem that there is high possibility of false detection of the discharge start voltage when the toner is supplied to the developing roller.

SUMMARY OF THE INVENTION

In view of the above-mentioned problem, it is an object of the present disclosure to prevent toner from moving from the magnetic roller to the developing roller in the discharge start voltage detection mode also in a structure in which AC voltage is applied to the magnetic roller when AC voltage is applied to the developing roller.

An image forming apparatus according to a first aspect of the present disclosure includes a developing roller disposed to be opposed to a photoreceptor drum, so as to carry toner, a magnetic roller disposed to be opposed to the developing roller, so as to form a magnetic brush by carrier in developer so that toner in the developer is supplied to the developing roller and that toner remaining on the surface of the developing roller after development is collected by the magnetic brush, a high voltage power supply including a transformer having two or more secondary winding, one of secondary side outputs being connected to the developing roller while the other output being connected to the magnetic roller, so as to apply AC voltages to the developing roller and the magnetic roller, a detection portion for detecting occurrence of discharge between the developing roller and the photoreceptor drum, a restriction portion for restricting movement of toner from the magnetic roller to the developing roller, and a moving portion configured to move the restriction portion in a discharge start voltage detection mode in which the high voltage power supply changes the AC voltage to be applied to the developing roller step by step so that a discharge start voltage is detected by using the detection portion, so as to restrict the movement of toner to the developing roller, and to draw back the restriction portion so that the toner can move to the developing roller when printing is executed.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Now, an embodiment of the present disclosure is described with reference to FIG. 1 to FIG. 10. In this embodiment, an electrophotographic tandem printer 100 (corresponding to an image forming apparatus) including a developing device 1 is exemplified and described. However, elements such as structures and layouts described in this embodiment are merely examples for description and should not be interpreted to limit the scope of the disclosure.

(Outline of Image Forming Apparatus)

Figure 1:
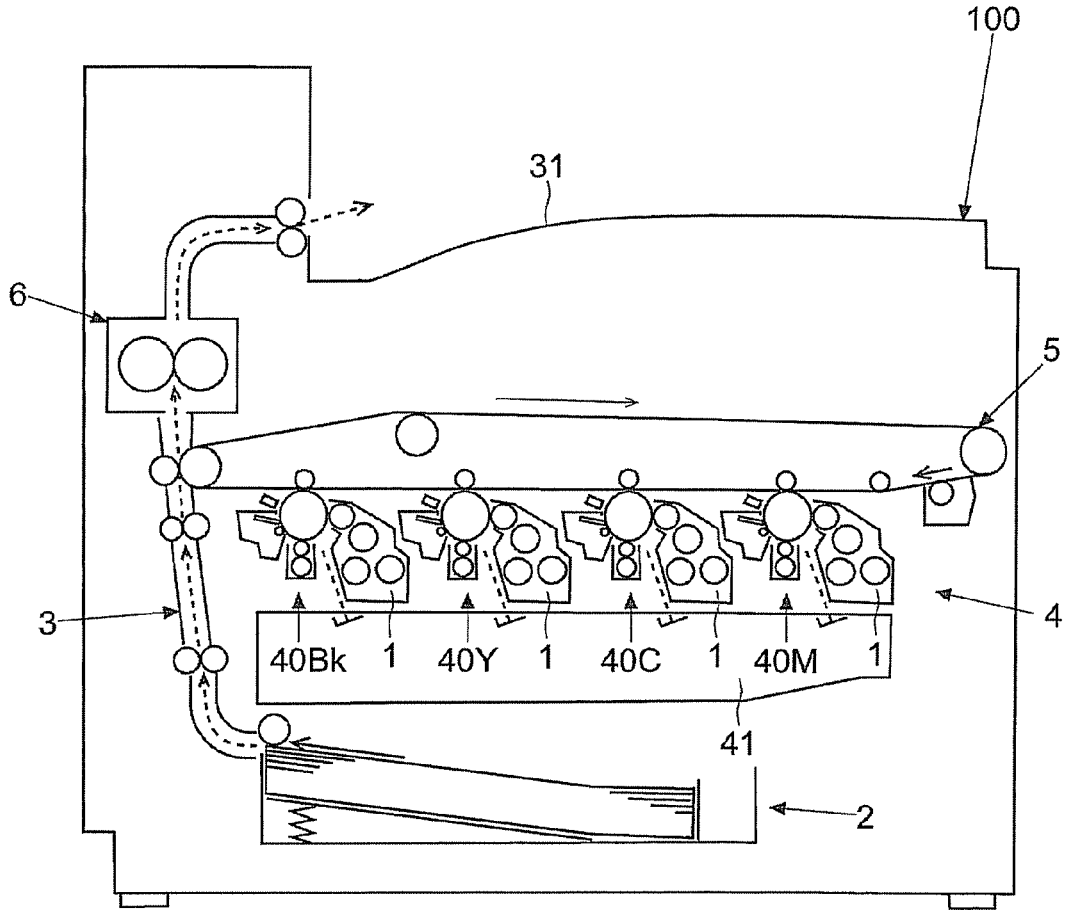
FIG. 1 is a diagram illustrating a structure of a printer.
Figure 2:
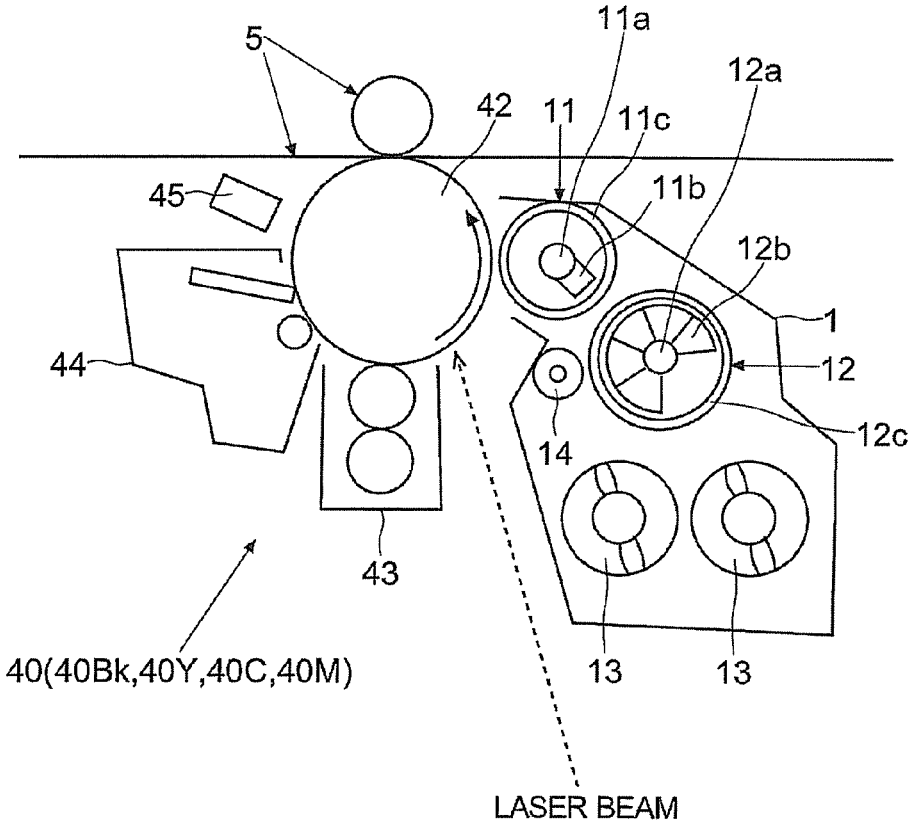
FIG. 2 is a diagram illustrating an image forming unit.

First, with reference to FIG. 1 and FIG. 2, an outline of the printer 100 according to the embodiment is described. FIG. 1 is a diagram illustrating a structure of the printer 100. FIG. 2 is a diagram illustrating an image forming unit 40.

As illustrated in FIG. 1, the printer 100 of this embodiment includes a paper sheet feeder 2, a transport portion 3, an image forming portion 4, an intermediate transfer portion 5, and a fixing portion 6 in a main body.

The paper sheet feeder 2 stores various paper sheets and sends out the paper sheets one by one to the transport portion 3. The transport portion 3 guides and transports the fed paper sheet to a discharge tray 31. The image forming portion 4 forms a toner image based on image data of an image to be formed. Further, the image forming portion 4 includes four color image forming units 40Bk (black), 40Y (yellow), 40C (cyan), and 40M (magenta), and an exposing device 41.

Here, with reference to FIG. 2, the image forming units 40 (40Bk, 40Y, 40C, and 40M) are described in detail. The image forming units 40 form different colors of the toner images but basically have the same structure. Therefore, in the following description, the image forming unit 40Bk is exemplified and is described. In addition, in the following description, symbols Bk, Y, C, and M indicating colors are omitted unless otherwise noted, and the same member is denoted by the same numeral or symbol in the image forming unit 40.

As illustrated in FIG. 2, each image forming unit 40 includes a photoreceptor drum 42, a charging device 43, the developing device 1, a cleaning device 44, and a charge neutralizer 45.

Figure 3:
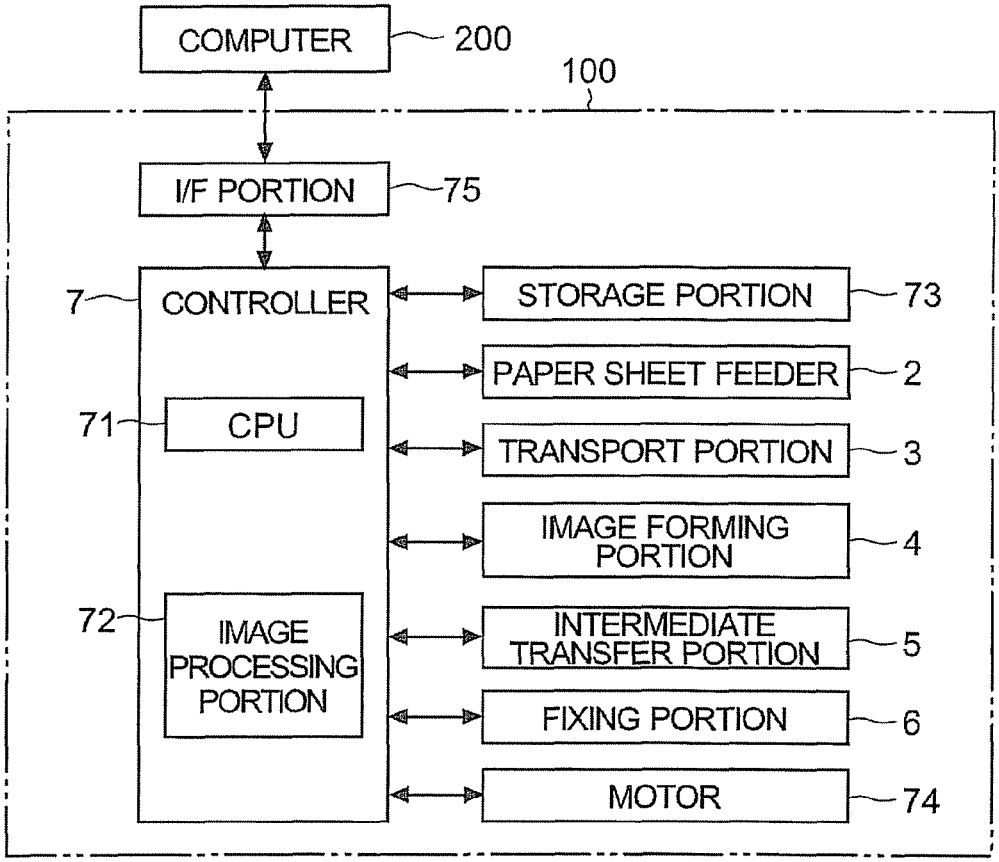
FIG. 3 is a diagram illustrating a hardware structure of the printer.

The photoreceptor drum 42 includes a base made of a metal such as aluminum and a photosensitive layer formed on the outer circumference surface of the base, and is rotated by a drive force from a motor 74 (see FIG. 3). Further, the photoreceptor drum 42 bears a toner image on its circumference surface after processes of electrification, exposure, and development (image bearing member). Note that the photoreceptor drum 42 of this embodiment is a positively charged type (toner is also a positively charged type).

The charging device 43 charges the surface of the photoreceptor drum 42 at a constant potential. The exposing device 41 irradiates the charged photoreceptor drum 42 with light (laser beam as illustrated in FIG. 2 by a broken line) based on an image signal obtained by color separation of the image data, so as to scan and expose the photoreceptor drum 42. The photoreceptor drum 42 of this embodiment is positively charged so that positively charged toner adheres to parts of the photoreceptor drum 42 in which potential is decreased by the irradiation with light. In this way, an electrostatic latent image according to the image data is formed on the circumference surface of the photoreceptor drum 42.

The developing device 1 stores a developer containing toner and magnetic carrier (so-called two-component developer) (40Bk stores black developer, 40Y stores yellow developer, 40C stores cyan developer, and 40M stores magenta developer). Each developing device 1 is connected to a container (not shown) storing the developer, and the toner is supplied from the container to the developing device 1 along with consumption of the toner.

The developing device 1 includes a developing roller 11, a magnetic roller 12, a transport member 13, and a bristle cutting roller 14. The developing roller 11 is opposed to the corresponding photoreceptor drum 42 so that axes thereof are parallel to each other. In addition, there is a gap between the developing roller 11 and the corresponding photoreceptor drum 42. The gap has a predetermined length (for example, approximately 0.05 mm to 1 mm).

In printing, a thin layer of toner is formed on the circumference surface of the developing roller 11. Further, the developing roller 11 carries charged toner. In addition, in order to permit toner to fly to the photoreceptor drum 42 so that the electrostatic latent image is developed, a voltage is applied to the developing roller 11 (details are described later).

The magnetic roller 12 is opposed to the developing roller 11 so that axes thereof are parallel to each other. In order to supply toner to the developing roller 11, and to collect and take off the toner, a voltage is applied to the magnetic roller 12 (details are described later).

The developing device 1 includes two transport members 13. The transport members 13 are disposed below the magnetic roller 12. The two transport members 13 have different rotation directions. The transport member 13 has a helical spiral screw so as to stir and transport the developer (toner and carrier). The toner is charged by friction with the carrier due to the transportation.

A roller shaft 11*a* of the developing roller 11 and a roller shaft 12*a* of the magnetic roller 12 are fixedly supported by a support member (not shown) or the like. Further, a magnet 11*b* having a rectangular cross section extending in an axial direction is attached to the roller shaft 11*a* of the developing roller 11. In addition, a magnet 12*b* having a rectangular cross section extending in the axial direction is attached to the roller shaft 12*a* of the magnetic roller 12. The magnet 12*b* is a multipolar magnet. On the circumference surface of the magnetic roller 12, the polarity changes at a constant interval in a circumferential direction. In addition, the developing roller 11 and the magnetic roller 12 have cylindrical sleeves 11*c* and 12*c* covering the magnet 11*b* and the magnet 12*b*, respectively. The sleeves 11*c* and 12*c* are rotated by a drive mechanism (not shown).

Further, the magnetic poles of the magnet 11*b* and the magnet 12*b* are disposed so that different poles are opposed to each other in the opposing position between the developing roller 11 and the magnetic roller 12 (in which the gap between the developing roller 11 and the magnetic roller 12 is smallest). In this way, the magnetic brush is formed by the magnetic carrier at the gap between the developing roller 11 and the magnetic roller 12. When the sleeve 12*c* of the magnetic roller 12 carrying the magnetic brush is rotated and a voltage is applies to the magnetic roller 12, the toner is supplied to the developing roller 11 so that a thin layer of toner is formed on the developing roller 11. In addition, the magnetic brush takes off and collects the toner remaining on the surface of the developing roller 11.

In addition, the bristle cutting roller 14 restricts a layer thickness of the developer including toner and carrier on the circumference surface of the magnetic roller 12. A constant thickness of the developer layer is formed by the bristle cutting roller 14 on the circumference surface of the magnetic roller 12 between the bristle cutting roller 14 and the opposing position between the developing roller 11 and the magnetic roller 12.

The cleaning device 44 cleans the photoreceptor drum 42. The cleaning device 44 scrapes the surface of the photoreceptor drum 42 so as to remove the remaining toner and the like. In addition, there is disposed the charge neutralizer 45 (for example, an LED array) for irradiating the photoreceptor drum 42 with light so as to remove electric charge.

With reference to FIG. 1 again, the description is continued. The intermediate transfer portion 5 receives primary transfer of the toner image from the photoreceptor drum 42 and performs secondary transfer to the paper sheet. The fixing portion 6 fixes the toner image to the paper sheet. The paper sheet after fixing is discharged to the discharge tray 31, and hence printing of one paper sheet is completed.

(Hardware Structure of Printer 100)

Next, with reference to FIG. 3, a hardware structure of the printer 100 according to the embodiment is described. FIG. 3 is a diagram illustrating a hardware structure of the printer 100.

As illustrated in FIG. 3, the printer 100 includes a controller 7. The controller 7 controls individual portions of the apparatus. The controller 7 includes a circuit and elements such as a CPU 71 and an image processing portion 72 for performing processing and calculation. In addition, the controller 7 includes a storage portion 73 as a combination of volatile and nonvolatile storage devices such as a ROM, a RAM, a flash ROM, and the like.

The CPU 71 performs control and calculation of individual portions of the printer 100 based on a control program and control data stored in the storage portion 73. The storage portion 73 stores the control program for the printer 100, the control data, and various data. Further, the storage portion 73 also stores a program and data concerning setting of voltage application to the developing roller 11 and the magnetic roller 12, such as a duty ratio of voltage application to the developing roller 11 and the magnetic roller 12, amplitude of the AC voltage, and set values of a DC bias voltage in the discharge start voltage detection mode and in printing.

Further, the controller 7 is connected to the paper sheet feeder 2, the transport portion 3, the image forming portion 4, the intermediate transfer portion 5, the fixing portion 6, and the like. The controller 7 controls operations of the individual portions so that the image formation is appropriately performed based on the control program and data in the storage portion 73. In addition, the controller 7 controls one or more motors 74 disposed in the printer 100. The controller 7 rotates the motor 74 to rotate various members such as a photoreceptor drum 42, the developing roller 11, the magnetic roller 12, and the like. Using drive of this motor 74, the sleeve 11*c* of the developing roller 11 and the sleeve 12*c* of the magnetic roller 12 rotate.

In addition, the controller 7 is connected to a computer 200 (a personal computer or a server) via an I/F portion 75 (interface portion). The I/F portion 75 receives print data including print content (image data and setting data) from the computer 200. The controller 7 controls the image processing portion 72 to execute image processing based on the received print data and controls the image forming portion to form a toner image.

(Voltage Application in Developing Device 1)

Figure 4:
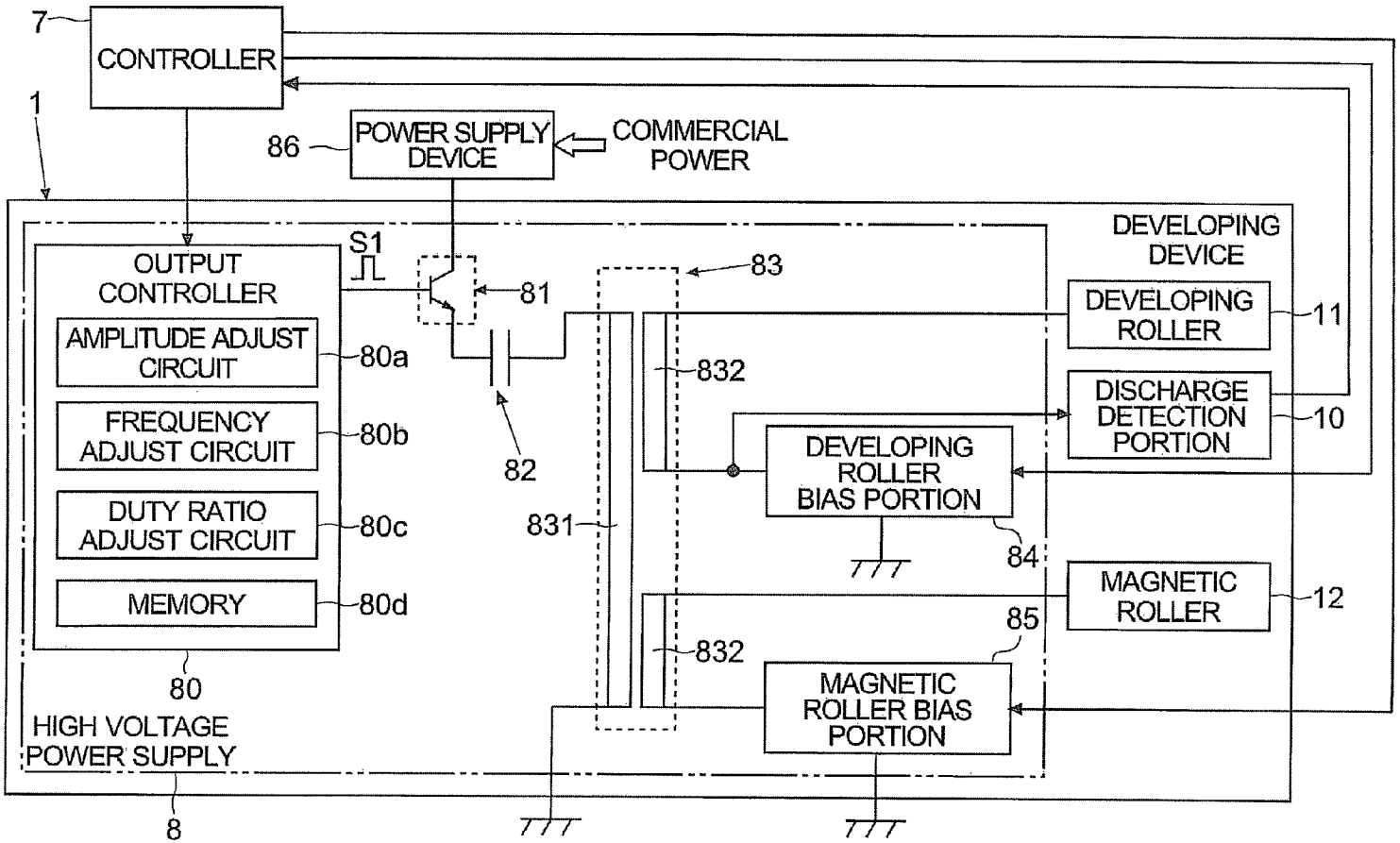
FIG. 4 is a diagram for explaining a developing device.
Figure 5:
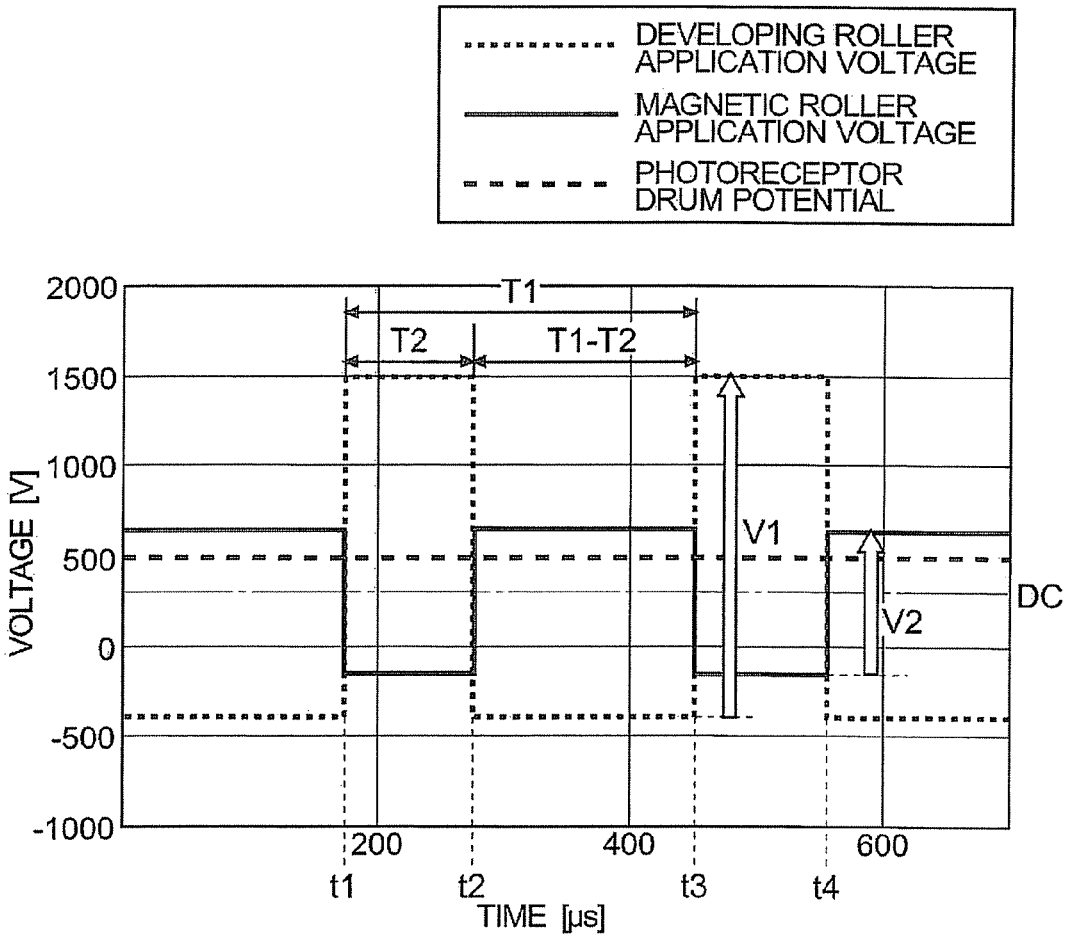
FIG. 5 is a timing chart illustrating an example of a voltage waveform to be applied to a developing roller.

Next, with reference to FIG. 4, voltage application in the developing device 1 is described. FIG. 4 is a diagram illustrating the developing device 1. FIG. 5 is a timing chart illustrating an example of a voltage waveform to be applied to the developing roller 11.

As described above, the developing device 1 includes the developing roller 11 and the magnetic roller 12. In order to develop the electrostatic latent image with toner, to supply toner to the developing roller 11, and to collect toner from the developing roller 11, voltages are applied to the developing roller 11 and the magnetic roller 12. In other words, in order to appropriately move the toner, voltages are applied to the developing roller 11 and the magnetic roller 12.

The developing device 1 includes a high voltage power supply 8 for applying voltages to the developing roller 11 and the magnetic roller 12. The high voltage power supply 8 steps up a supplied voltage so as to apply (output) the voltages to the developing roller 11 and the magnetic roller 12.

The high voltage power supply 8 of this embodiment includes an output controller 80, a transistor 81 (npn type), a capacitor 82, a transformer 83, a developing roller bias portion 84, and a magnetic roller bias portion 85. Timings at which the developing device 1 starts and finishes the development are different for each color. Therefore, the high voltage power supply 8 is disposed for each developing device 1 (one set of the developing roller 11 and the magnetic roller 12).

Collector of the transistor 81 is connected to a power supply device 86. The power supply device 86 is disposed inside the printer 100 and performs rectifying and smoothing of a commercial power so as to output a DC voltage. The power supply device 86 outputs and applies DC 24 V or DC 5 V to the transistor 81.

Base of the transistor 81 is connected to the output controller 80. The output controller 80 supplies a control signal S1 (clock signal) to the base of the transistor 81. The transistor 81 performs switching based on the control signal S1.

The output controller 80 receives an instruction of the AC voltages to be applied to the developing roller 11 and the magnetic roller 12 from the controller 7. Further, the output controller 80 generates a drive signal according to the AC voltages to be applied to the developing roller 11 and the magnetic roller 12.

Emitter of the transistor 81 is connected to the capacitor 82. The capacitor 82 is connected a primary side (primary winding) of the transformer 83. A signal (voltage) obtained by removing a DC component from a waveform obtained by amplifying the control signal S1 output from the output controller 80 is supplied from the capacitor 82 to the transformer 83. In other words, the capacitor 82 supplies an AC waveform to the transformer 83.

The transformer 83 steps up a voltage supplied to a primary winding 831 (primary coil) on the primary side and outputs the stepped-up voltage from a secondary winding 832 (secondary coil). Further, the secondary side has at least two outputs. One of the outputs is connected to the developing roller 11, and the other output is connected to the magnetic roller 12. In other words, the secondary side of the transformer 83 includes at least two secondary windings (secondary coils). As a result, the AC voltages generated by the transformer 83 are applied to the developing roller 11 and the magnetic roller 12. Note that a step up ratio may be different between the outputs.

Specifically, the output controller 80 includes an amplitude adjust circuit 80*a* that can adjust an amplitude of the control signal S1, a frequency adjust circuit 80*b* that can adjust a frequency of the control signal S1, and a duty ratio adjust circuit 80*c* that can adjust a duty ratio of the control signal S1.

The amplitude adjust circuit 80*a* can change an amplitude of the control signal S1. In this way, the peak-peak voltages of the AC voltages to be applied to the developing roller 11 and the magnetic roller 12 can be changed. The frequency adjust circuit 80*b* can change a frequency of the control signal S1. In this way, a frequency of the AC voltages to be applied to the developing roller 11 and the magnetic roller 12 can be changed. In addition, the duty ratio adjust circuit 80*c* can change a duty ratio of the control signal S1. In this way, a duty ratio (time ratio between High state and Low state) of the AC voltages to be applied to the developing roller 11 and the magnetic roller 12 can be changed.

In addition, the developing roller bias portion 84 for biasing the AC voltage to be applied to the developing roller 11 by a DC voltage is disposed at the output on the developing roller 11 side. The AC voltage biased by a DC voltage by the developing roller bias portion 84 is applied to the developing roller 11. In the same manner, the magnetic roller bias portion 85 for biasing the AC voltage to be applied to the magnetic roller 12 by a DC voltage is also disposed at the output on the magnetic roller 12 side. In addition, the AC voltage biased by a DC voltage by the magnetic roller bias portion 85 is applied to the magnetic roller 12.

The developing roller bias portion 84 and the magnetic roller bias portion 85 output voltage value instructed from the controller 7. Each bias portion is a converter that receives the output voltage from the power supply device 86 so as to step up the voltage. Further, the developing roller bias portion 84 and the magnetic roller bias portion 85 are circuits that can change outputs.

In addition, the developing device 1 includes a discharge detection portion 10 (corresponding to a detection portion) for detecting whether or not discharge has occurred between the developing roller 11 and the photoreceptor drum 42. The discharge detection portion 10 includes a circuit that detects a variation of the DC voltage (DC component) to be applied to the developing roller 11 and outputs a voltage corresponding to the variation amount. For instance, the discharge detection portion 10 includes a differential amplifying circuit that amplifies a difference of voltage values between before and after the change of the DC voltage to be applied to the developing roller 11 and outputs the amplified value.

Then, the output of the discharge detection portion 10 is supplied to the controller 7. The controller 7 recognizes presence or absence of occurrence of discharge between the developing roller 11 and the photoreceptor drum 42, and the number of occurrence of discharge based on the output of the discharge detection portion 10. Note that it is possible to configure to detect the discharge between the developing roller 11 and the photoreceptor drum 42 by other method such as disposing a circuit for detecting current flowing in the photoreceptor drum 42.

Next, with reference to FIG. 5, an example of the voltages to be applied to the developing roller 11 and the magnetic roller 12 is described. First, in FIG. 5, a surface potential after the photoreceptor drum 42 is electrified is illustrated by a long-dashed broken line (approximately 500 V in the example of FIG. 5).

Further, in FIG. 5, an example of the voltage to be applied to the developing roller 11 is illustrated by a short-dashed broken line. The voltage to be applied to the developing roller 11 is generated based on the control signal S1 (clock signal) from the output controller 80 and changes at a constant period T1. Specifically, a voltage at time point t1 or t3 in FIG. 5 rises to High state, and a voltage at time point t2 or t4 falls to Low state. Note that the AC voltage to be applied to the developing roller 11 is biased by the developing roller bias portion 84, and therefore the AC voltage to be applied to the developing roller 11 has an average value that is the DC voltage output from the developing roller bias portion 84.

In the example of FIG. 5, a voltage that is approximately 1500 V in High state and is approximately −400 V in Low state is applied to the developing roller 11. Further, a peak-peak voltage V1 of the voltage to be applied to the developing roller 11 is approximately 1,900 to 2,000 V.

In addition, an example of the voltage to be applied to the magnetic roller 12 is illustrated by a solid line in FIG. 5. The voltage to be applied to the magnetic roller 12 is also generated based on the control signal S1 from the output controller 80. Because two outputs are generated from the one transformer 83, the AC voltage to be applied to the magnetic roller 12 also changes at the constant period T1. The secondary winding for the developing roller 11 and the secondary winding for the magnetic roller 12 have opposite winding directions. Specifically, the voltage falls to Low state at the time point t1 or t3 in FIG. 5 and rises to High state at the time point t2 or t4 (logic opposite to that of the AC voltage to be applied to the developing roller 11). Note that the AC voltage to be applied to the magnetic roller 12 is biased by the magnetic roller bias portion 85, and hence an average value of the AC voltage to be applied to the magnetic roller 12 is the DC voltage value output by the magnetic roller bias portion 85.

In the example of FIG. 5, a voltage that is approximately 550 to 700 V in High state and is approximately −100 to −200 V in Low state is applied to the magnetic roller 12. Further, a peak-peak voltage V2 of the voltage to be applied to the magnetic roller 12 is approximately 800 to 1,000 V.

Further, the output controller 80 increases an amplitude of the control signal S1 so as to increase peak-peak voltages of the voltages to be applied to the developing roller 11 and the magnetic roller 12. On the contrary, the output controller 80 decreases the amplitude of the control signal S1 so as to decrease the peak-peak voltages of the voltages to be applied to the developing roller 11 and the magnetic roller 12. In other words, the output controller 80 can control the peak-peak voltages of the voltages to be applied to the developing roller 11 and the magnetic roller 12. The output controller 80 controls the peak-peak voltage based on data stored in a memory 80*d* indicating the amplitude of the control signal S1 corresponding to the peak-peak voltage to be applied to the developing roller 11.

Here, there is a tendency that when the peak-peak voltage is increased, a period necessary for the voltage to rise or fall becomes longer, and a period of High state of the voltage to be applied to the developing roller 11 (period of positive peak value illustrated in FIG. 5 by T2) becomes shorter. Therefore, in any peak-peak voltage, in order to secure the same period of the peak value of the voltage to be applied to the developing roller 11 for the toner to fly, the output controller 80 adjusts a frequency or a duty ratio of the control signal S1. Specifically, the output controller 80 sets the duty ratio of the control signal S1 (ratio of High period T2 to the period T1) to be larger or sets the frequency to be lower as the peak-peak voltage is higher. The output controller 80 adjusts the duty ratio or the frequency in accordance with the peak-peak voltage to be applied to the developing roller 11, based on the data stored in the memory 80*d* defining the frequency and the duty ratio of the control signal S1 corresponding to the peak-peak voltage to be applied to the developing roller 11.

(Discharge Start Voltage Detection Mode and Setting of AC Voltage to be Applied to Developing Roller 11)

Figure 6:
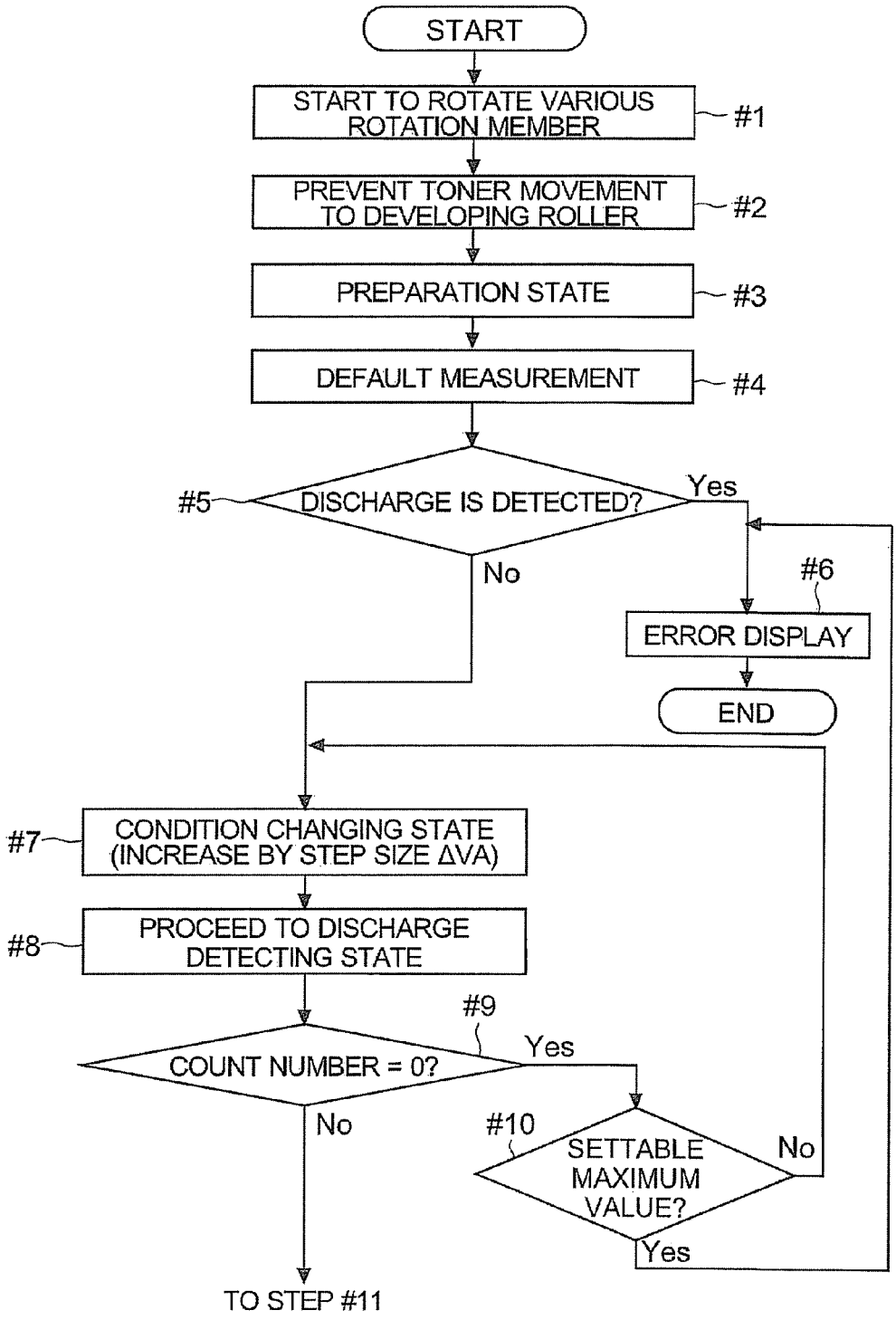
FIGS. 6 and 7 are flowcharts illustrating a flow of operation in a discharge start voltage detection mode.
Figure 7:
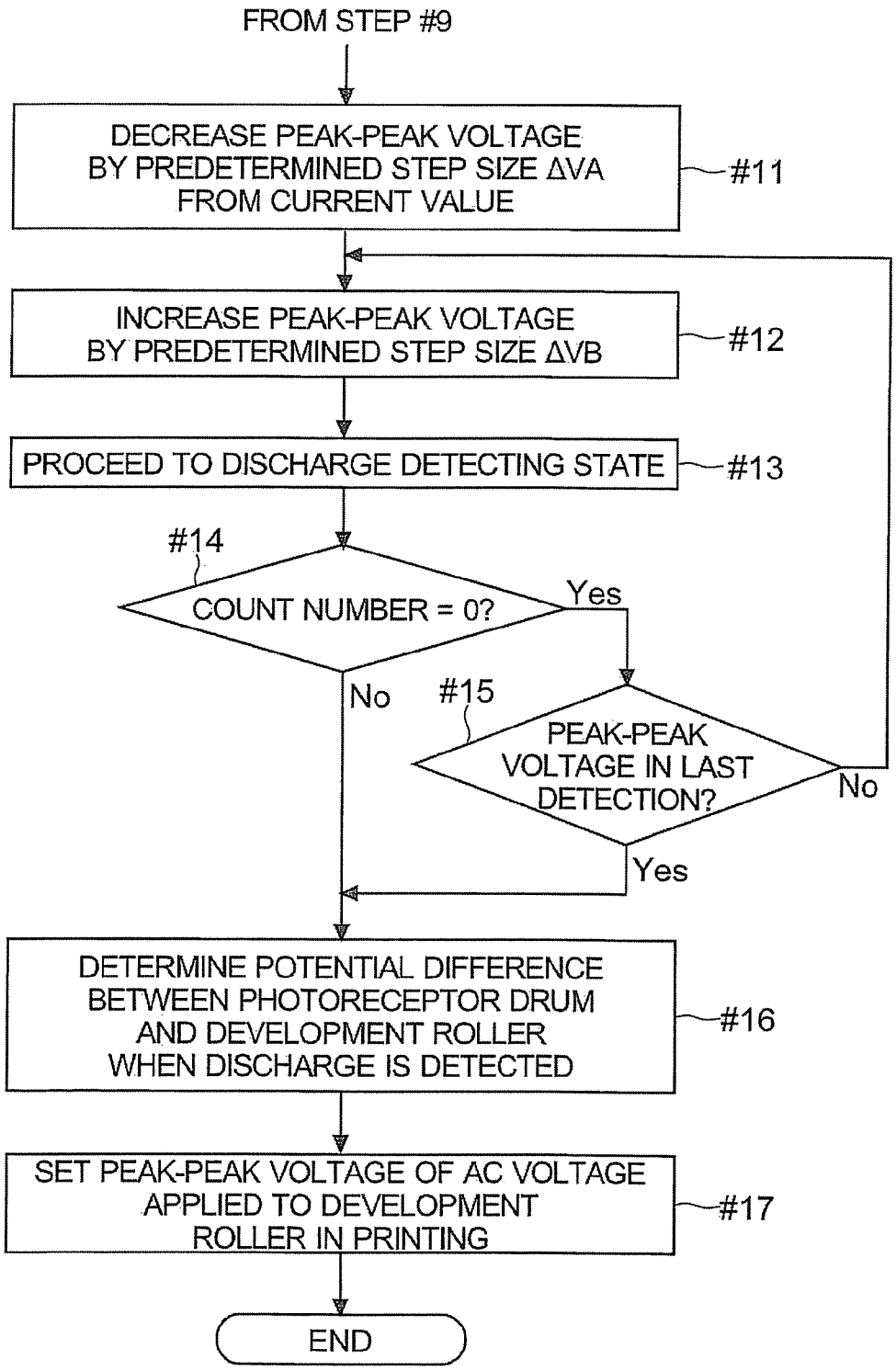

Next, with reference to FIG. 6 and FIG. 7, there is described a flow of operation in the discharge start voltage detection mode of the printer 100 according to the embodiment. FIG. 6 and FIG. 7 illustrate a series of flowcharts of a flow of operation in the discharge start voltage detection mode. Note that the flowchart illustrates control for the single developing device 1 and executed four times for all colors in this embodiment.

First, as the peak-peak voltage of the AC voltage to be applied to the developing roller 11 is larger, the charged toner is apt to fly easily, and the developed toner image is apt to have high density. In addition, even if development time is short (rotation speed of the photoreceptor drum 42 is high), sufficiently high density of toner is developed. Therefore, development efficiency is higher as the peak-peak voltage of the AC voltage to be applied to the developing roller 11 is higher.

However, because a gap between the developing roller 11 and the photoreceptor drum 42 is very small, when the peak-peak voltage of the AC voltage to be applied to the developing roller 11 is set to be too large, discharge may occur. When discharge occurs, surface potential of the photoreceptor drum 42 is disturbed so that image quality is deteriorated, or the photoreceptor drum 42 is damaged by a micro hole formed due to piercing discharge current. Therefore, it is preferred to apply the AC voltage having as high peak-peak voltage as possible without causing discharge to the developing roller 11.

However, the discharge start voltage (a peak-peak voltage at which discharge occurs, or a potential difference between the photoreceptor drum 42 and the developing roller 11 at which discharge occurs) is different depending on an environment where the printer 100 is installed (altitude and atmospheric pressure) or an individual difference of the gap between the photoreceptor drum 42 and the developing roller 11 (manufacturing error of the photoreceptor drum 42 or the developing roller 11 or attachment error thereof).

Considering this point, the printer 100 of this embodiment has the discharge start voltage detection mode for detecting the discharge start voltage. Therefore, with reference to FIG. 6 and FIG. 7, there is described an operation in the discharge start voltage detection mode.

In finding an early failure in the manufacturing process, in an initial setting, in installation of the printer 100, or in replacing a developing device 1 or the photoreceptor drum 42, execution is instructed by the operation panel, and hence it is possible to execute the detection of the discharge start voltage in the discharge start voltage detection mode and the adjustment of the voltage to be applied to the developing roller 11. In addition, it is possible to execute the detection of the discharge start voltage every time when the printer 100 prints a certain number of sheets. The execution timing can be appropriately set.

First, the flow of FIG. 6 starts at a time point (START) when a start condition of the discharge start voltage detection mode is satisfied, for example, a predetermined operation is performed with an operation portion (not shown) such as the operation panel. Further, the controller 7 controls the motor 74 and a drive mechanism (not shown) to start rotation of various rotation members in the image forming portion 4 and the intermediate transfer portion 5 such as the photoreceptor drum 42, the sleeve 11*c* of the developing roller 11, the sleeve 12*c* of the magnetic roller 12, and an intermediate transfer belt 52 (Step #1). The drive of the individual rotation members are continued until the discharge start voltage detection mode is finished.

Then, the controller 7 controls a moving portion 91 to move a restriction portion 90 for restricting supply of toner from the magnetic roller 12 to the developing roller 11, so as to prevent (restrict) movement of toner to the developing roller 11 (Step #2). Details of the restriction portion 90 and the moving portion 91 will be described later. Note that it is possible to configure the controller 7 to control the magnetic roller 12 to supply (move) a small amount of toner to the developing roller 11 by applying a voltage to the magnetic roller bias portion 85 before preventing the movement of toner to the developing roller 11, in order to relieve friction between the photoreceptor drum 42 and the intermediate transfer belt 52, or friction between the photoreceptor drum 42 and the cleaning device 44.

Next, the controller 7 controls the printer 100 to proceeds to a preparation state for detecting the discharge start voltage (Step #3). In the preparation state, the controller 7 controls a charging device 43 to charge the photoreceptor drum 42. Note that the charging device 43 continues to charge the photoreceptor drum 42 until the discharge start voltage detection mode is finished.

Next, the controller 7 increases the peak-peak voltage of the AC voltage to be applied to the developing roller 11 up to a predetermined peak-peak voltage in the default measurement (initial measurement) (simultaneously, the peak-peak voltage of the AC voltage to be applied to the magnetic roller 12 is also increased), so as to perform default measurement (Step #4). In this case, the controller 7 checks whether or not discharge has occurred based on the output of the discharge detection portion 10 (Step #5).

Here, also in the discharge start voltage detection mode, the controller 7 controls the developing roller bias portion 84 to apply the DC voltage to the developing roller 11 and controls the magnetic roller bias portion 85 to apply the DC voltage to the magnetic roller 12. The DC voltage values to be applied to the developing roller 11 and the magnetic roller 12 are the same values as in the case of printing, for example.

The default measurement is performed in a state (with a parameter) where discharge hardly occurs. Specifically, in the default measurement, the controller 7 controls the high voltage power supply 8 to output and apply the AC voltage having a settable minimum peak-peak voltage to the developing roller 11. The default measurement is performed for confirming occurrence of discharge in a state where discharge hardly occurs so as to find abnormalities of the discharge detection portion 10 and the high voltage power supply 8 or abnormal set positions of members such as the photoreceptor drum 42 and the developing roller 11.

When occurrence of discharge is detected in the default measurement (Yes in Step #5), an abnormality such as a failure is considered. Therefore, the controller 7 controls the operation panel to perform an error display (Step #6). Then, the discharge start voltage detection mode is finished (END).

On the other hand, when occurrence of discharge is not detect in the default measurement (No in Step #5), the controller 7 controls the printer 100 to proceed to a condition changing state (Step #7).

In the condition changing state, the controller 7 increases step by step the peak-peak voltage of the AC voltage to be applied to the developing roller 11 in the default measurement or the discharge detecting state just before discharge has not been detected. Specifically, the controller 7 controls the high voltage power supply 8 to increase the peak-peak voltage of the AC voltage to be applied to the developing roller 11 by a predetermined step size ΔVa (for example, 30 to 100V) from the current voltage (in the default measurement or the discharge detecting state just before discharge has not been detected) and to output the increased voltage.

Next, the controller 7 controls the printer 100 to proceed to the discharge detecting state (Step #8). In the discharge detecting state, the controller 7 checks whether or not discharge has occurred based on the output of the discharge detection portion 10, in the state where the AC voltage to be applied to the developing roller 11 is increased by the step size ΔVa. Further, the controller 7 counts for a constant period (a few hundreds milliseconds to a few seconds) the number of times when the output of the discharge detection portion 10 voltage exceeds a predetermined threshold value.

In addition, in the discharge detecting state, the controller 7 controls to apply a voltage to the developing roller 11 and controls an exposing device 41 to continuously expose the photoreceptor drum 42 (to expose the entire surface of the photoreceptor drum 42 so as to form an electrostatic latent image of solid fill).

Further, the controller 7 checks whether or not a count number (the number of times when the threshold value is exceeded) is zero (Step #9). When the count number is zero (Yes in Step #9), the controller 7 checks whether or not the current peak-peak voltage has reached a sellable maximum value (Step #10). When the current peak-peak voltage has reached the settable maximum value (Yes in Step #10), there is a possibility that the AC voltage is not normally output from the high voltage power supply 8. Therefore, the process proceeds to Step #6, and the flow (discharge start voltage detection mode) is finished (END). On the other hand, when the current peak-peak voltage has not reached the settable maximum value (No in Step #10), the flow returns to Step #7.

In this way, returning to the condition changing state, the AC voltage to be applied to the developing roller 11 is increase by the step size ΔVa to be the discharge detecting state. Therefore, the condition changing state and the discharge detecting state are repeated until the AC voltage (peak-peak voltage) at which discharge occurs is recognized. During the repetition, the peak-peak voltage of the AC voltage to be applied to the developing roller 11 is increased basically step by step by the constant step size.

On the other hand, when the count value is one or larger (No in Step #9), as occurrence of discharge, the controller 7 decreases the peak-peak voltage of the AC voltage applied to the developing roller 11 when occurrence of discharge is detected, by the predetermined step size ΔVa (Step #11). Further, the controller 7 controls the high voltage power supply 8 to output the value increased by a predetermined step size ΔVb (Step #12).

Here, the predetermined step size ΔVb is smaller than the predetermined step size ΔVa (for example, ΔVa is 50V, while ΔVb is 10V or a fraction of ΔVa). In other words, in order to find the peak-peak voltage at which discharge occurs (starts) in more detail, the step size of the step change of the peak-peak voltage is decreased after returning by one step.

After that, the controller 7 controls the printer 100 to proceed to the discharge detecting state and counts the number of times when the output of the discharge detection portion 10 voltage exceeds the predetermined threshold value (Step #13). Next, after the discharge detecting state for a constant period, the controller 7 checks whether or not the count number is zero (Step #14).

When the count number is zero (Yes in Step #14), the controller 7 checks whether or not the current peak-peak voltage of the AC voltage applied to the developing roller 11 has reached the peak-peak voltage at which discharge was detected before (Step #15). When the current peak-peak voltage has not reached (No in Step #15), the flow returns to Step #12.

On the other hand, when the count value is one or larger (No in Step #14), and when the current peak-peak voltage has reached (Yes in Step #15), the controller 7 recognizes that discharge starts at the current peak-peak voltage, and the flow proceeds to Step #16.

Next, Step #16 is described in detail. In Step #16, the controller 7 determines a potential difference between the photoreceptor drum 42 and the developing roller 11 when discharge is detected, based on the peak-peak voltage when occurrence of discharge is detected between the developing roller 11 and the photoreceptor drum 42 (peak-peak voltage at which it is detected that discharge starts), a frequency and a duty ratio of the AC voltage to be applied to the developing roller 11, and a DC bias value of the voltage to be applied to the developing roller 11 (output value of the developing roller bias portion 84).

Here, there is described an example of a method of determining the potential difference between the photoreceptor drum 42 and the developing roller 11 when discharge is detected. The controller 7 specifies the peak-peak voltage and issues an instruction to the output controller 80 so as to control the high voltage power supply 8 to output the AC voltage to be applied to the developing roller 11. Therefore, the controller 7 recognizes the peak-peak voltage when occurrence of discharge is detected. In addition, the controller 7 instructs the developing roller bias portion 84 about the DC voltage value to be output so as to control the developing roller bias portion 84 to output the DC voltage value corresponding to the instruction.

Here, at the voltage to be applied to the developing roller 11, the product of an absolute value of a potential difference between the DC bias value and a positive side peak value of the voltage to be applied to the developing roller 11 and a time of the positive side (High) in one period is equal to the product of an absolute value of a potential difference between the DC bias value and a negative side peak value of the voltage to be applied to the developing roller 11 and a time of the negative side (Low) in one period. Therefore, the controller 7 can determine the potential difference between the photoreceptor drum 42 and the developing roller 11 at which discharge occurs by calculation based on a duty ratio and a frequency (period) of the AC voltage to be applied to the developing roller 11 (control signal S1), the peak-peak voltage, and the DC bias value of the voltage to be applied to the developing roller 11. In addition, the controller 7 may determine a potential difference between the developing roller 11 and the ground at which discharge occurs (by addition or subtraction) based on the potential difference between the photoreceptor drum 42 and the developing roller 11 at which discharge occurs and the DC bias value.

Next, on the basis of the determined voltage (potential difference) at which discharge starts, the controller 7 sets the peak-peak voltage of the AC voltage to be applied to the developing roller 11 in printing. Specifically, in printing, a predetermined margin is secured so that the potential difference between the peak value of the voltage to be applied to the developing roller 11 and the photoreceptor drum 42 becomes smaller than the determined discharge start voltage, and the peak-peak voltage of the AC voltage to be applied to the developing roller 11 in printing is set (Step #17). A margin by which discharge does not occur is determined based on an experiment in the developing stage considering the toner to be used. Further, the controller 7 determines the peak-peak voltage in printing to be the peak-peak voltage having a value with the margin to the discharge start voltage determined as the potential difference between the photoreceptor drum 42 and the developing roller 11 at which discharge starts. Further, when setting of the peak-peak voltage is completed, the flow is finished (END).

(Restriction of Toner Supply to Developing Roller 11 in Discharge Start Voltage Detection Mode)

Figure 8:
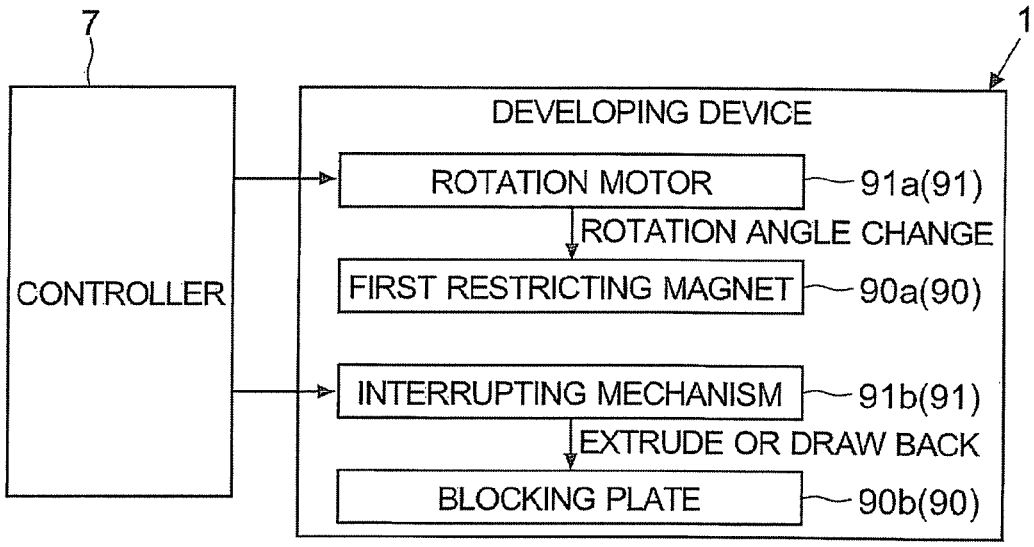
FIG. 8 is a diagram illustrating a restriction portion and a moving portion disposed in the developing device.
Figure 9:
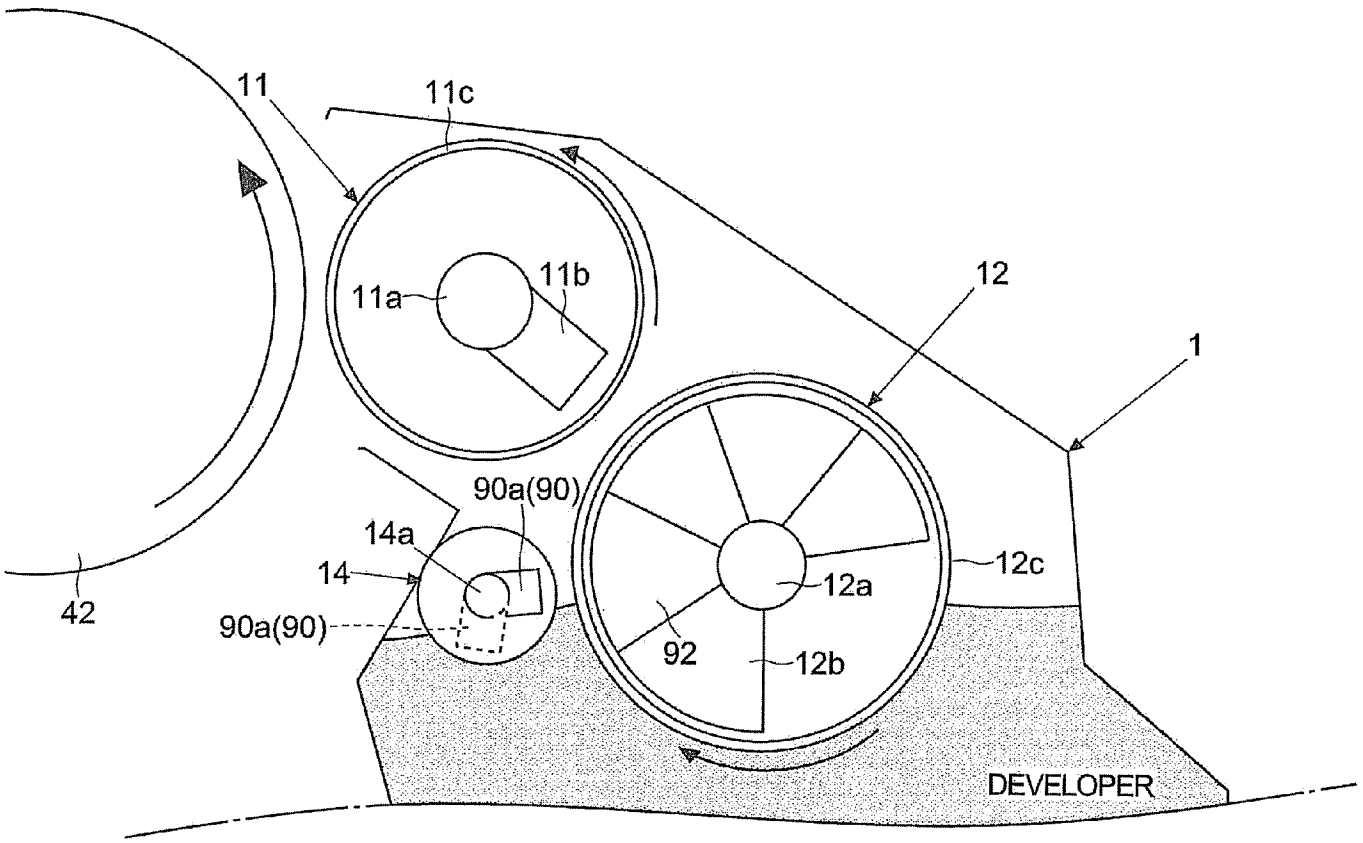
FIG. 9 is a diagram for explaining restriction of supplying toner to the developing roller by a bristle cutting roller.
Figure 10:
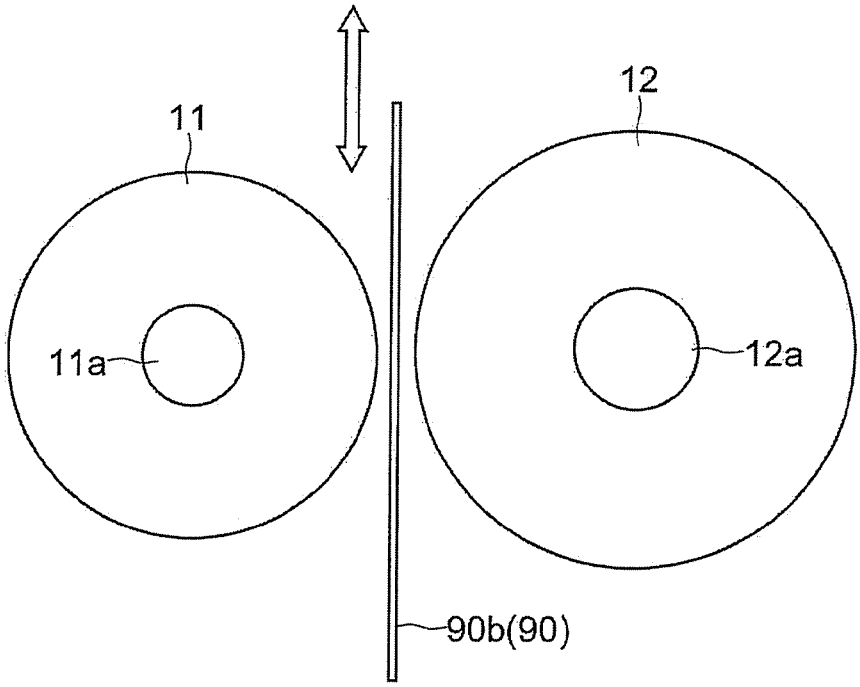
FIG. 10 is a diagram for explaining restriction of supplying toner to the developing roller by a blocking plate.

Next, with reference to FIG. 8 to FIG. 10, restriction of toner supply to the developing roller 11 is described. FIG. 8 is a diagram illustrating the restriction portion 90 and the moving portion 91 disposed in the developing device 1. FIG. 9 is a diagram for explaining restriction of toner supply to the developing roller 11 by the bristle cutting roller 14. FIG. 10 is a diagram for explaining restriction of toner supply to the developing roller 11 by a blocking plate 90*b*.

In the discharge start voltage detection mode, the printer 100 of this embodiment restricts toner supply (movement) to the developing roller 11. In other words, in the discharge start voltage detection mode, the developing roller 11 (sleeve 11*c* thereof) carries toner as little as possible.

Because the toner is electrified, when the toner flies from the developing roller 11 in the discharge start voltage detection mode, it may be detected as movement of charge by the discharge detection portion 10. Therefore, the toner movement from the developing roller 11 to the photoreceptor drum 42 may affect the output of the discharge detection portion 10 so that the controller 7 detects falsely occurrence of discharge.

Therefore, the printer 100 of this embodiment (developing device 1) is equipped with the restriction portion 90 and the moving portion 91. Further, in the discharge start voltage detection mode, the controller 7 controls the moving portion 91 to move the restriction portion 90 so that a position of the restriction portion 90 becomes a position for restricting (preventing) toner movement to the developing roller 11.

Specifically, as illustrated in FIG. 8 and FIG. 9, as the restriction portion 90, there is disposed a first restricting magnet 90*a* in the bristle cutting roller 14. In addition, as the moving portion 91 for rotating the first restricting magnet 90*a*, there is disposed a rotation motor 91*a* (corresponding to a rotating portion).

As illustrated in FIG. 8, in the discharge start voltage detection mode, the controller 7 controls the rotation motor 91*a* to operate so as to rotate the first restricting magnet 90*a* to an angle (position) for preventing toner from moving to the developing roller 11. Further, when the discharge start voltage detection mode is finished, the controller 7 controls the rotation motor 91*a* to operate so as to rotate the first restricting magnet 90*a* to an angle for smoothly supplying toner to the developing roller 11.

Specifically, with reference to FIG. 9, there is described the restriction of movement to the developing roller 11 by the bristle cutting roller 14. FIG. 9 illustrates a diagram in which the developing roller 11 and the magnetic roller 12 of the developing device 1 are partially enlarged. Further, in FIG. 9, rotation directions of the photoreceptor drum 42, the sleeve 11*c* of the developing roller 11, the sleeve 12*c* of the magnetic roller 12 are indicated by solid lines with arrow. In addition, in FIG. 9, the developer (toner and carrier) in the developing device 1 is illustrated by half tone dot meshing.

First, in the developing device 1 of this embodiment, in order to form the magnetic brush by the carrier, there are disposed the magnet 11*b* in the sleeve 11*c* of the developing roller 11 and the magnet 12*b* in the sleeve 12*c* of the magnetic roller 12. The magnet 11*b* and the magnet 12*b* are disposed so that different magnetic poles are opposed to each other at the position where the developing roller 11 and the magnetic roller 12 are opposed to each other.

Further, the bristle cutting roller 14 has its longitudinal direction that is an axial direction of the magnetic roller 12 and is opposed to the magnetic roller 12 with a gap. In addition, the bristle cutting roller 14 is disposed on the left side of the magnetic roller 12 at a position on an upstream side in the rotation direction of the opposing position between the developing roller 11 and the magnetic roller 12 (position at which the magnetic brush is formed) by approximately ⅙ to ¼ of a circumference length of the magnetic roller 12.

The bristle cutting roller 14 makes a layer thickness of the developer carried by the sleeve 12*c* of the magnetic roller 12 be a predetermined constant thickness at a time point when reaching the magnetic brush between the developing roller 11 and the magnetic roller 12. In other words, the sleeve 12*c* of the magnetic roller 12 carries a developer layer having a thickness corresponding to the gap or smaller between the magnetic roller 12 and the bristle cutting roller 14.

Further, the first restricting magnet 90*a* is attached to a shaft 14*a* of the bristle cutting roller 14. The first restricting magnet 90*a* has its longitudinal direction that is the axial direction of the magnetic roller 12. In addition, the first restricting magnet 90*a* is fixed to the shaft 14*a* of the bristle cutting roller 14 with adhesive or the like. The shaft 14*a* of the bristle cutting roller 14 is rotated by the rotation motor 91*a*. The controller 7 can rotate the shaft 14*a* of the bristle cutting roller 14 so that the magnetic pole of the first restricting magnet 90*a* is at a position of the narrowest gap between the magnetic roller 12 and the bristle cutting roller 14 (position closest to the circumference surface of the magnetic roller 12). In addition, the controller 7 can also rotate the shaft 14*a* of the bristle cutting roller 14 so that the magnetic pole of the first restricting magnet 90*a* is at a position apart from the position of the narrowest gap between the magnetic roller 12 and the bristle cutting roller 14 (so as not to be opposed to the circumference surface of the magnetic roller 12).

In the discharge start voltage detection mode, the controller 7 controls the rotation motor 91*a* to operate. Further, the controller 7 moves the magnetic pole of the first restricting magnet 90*a* on the circumference surface side of the bristle cutting roller 14 to a position at which the gap between the magnetic roller 12 and the bristle cutting roller 14 is narrow. Note that FIG. 9 illustrates an example of a position of the first restricting magnet 90*a* in a normal mode by a broken line. In this way, the magnetic brush is formed in the gap between the magnetic roller 12 and the bristle cutting roller 14. Because of this magnetic brush, in the discharge start voltage detection mode, toner is not supply to the circumference surface of the sleeve 12*c* from the gap between the magnetic roller 12 and the bristle cutting roller 14 to the gap between the magnetic roller 12 and the developing roller 11 (magnetic brush forming position). In this way, toner is not moved to the developing roller 11 so that toner on the circumference surface of the developing roller 11 disappears.

In order to reinforce the magnetic brush formed between the magnetic roller 12 and the bristle cutting roller 14 (in order to enhance magnetic flux in the gap between the magnetic roller 12 and the bristle cutting roller 14), a polarity on the circumference surface side of the magnet 12*b* (second restricting magnet 92) at a position facing the gap between the magnetic roller 12 and the bristle cutting roller 14 is set to a polarity opposite to the magnetic pole of the first restricting magnet 90*a* on the circumference surface side. In other words, in the discharge start voltage detection mode, different poles of the first restricting magnet 90*a* and the second restricting magnet 92 are opposed to each other.

Further, when the discharge start voltage detection mode is finished so as to return to the normal mode for printing, the controller 7 controls the rotation motor 91*a* to operate. Further, the controller 7 separates the magnetic pole on the circumference surface side of the bristle cutting roller 14 of the first restricting magnet 90*a* from the gap between the magnetic roller 12 and the bristle cutting roller 14. In other words, the controller 7 rotates the first restricting magnet 90*a* to a position at which the magnetic brush is not formed in the gap between the magnetic roller 12 and the bristle cutting roller 14. For instance, the controller 7 rotates the first restricting magnet 90*a* to a position of 90 to 270 degrees with respect to the angle of the shaft 14*a* of the bristle cutting roller 14 at the line connecting the center of the shaft of the bristle cutting roller 14 and the center of the shaft of the magnetic roller 12 as zero degrees. Note that FIG. 9 illustrates an example of the position of the first restricting magnet 90*a* in the normal mode by a broken line.

Further, as illustrated in FIG. 8 and FIG. 10, the blocking plate 90*b* is disposed as the restriction portion 90. In addition, there is disposed an interrupting mechanism 91*b* as the moving portion 91 for extruding and drawing back the blocking plate 90*b*.

As illustrated in FIG. 8, in the discharge start voltage detection mode, the controller 7 controls the interrupting mechanism 91*b* to operate so as to move (extrude) the blocking plate 90*b* to the position for preventing the toner from moving to the developing roller 11. Further, when the discharge start voltage detection mode is finished, the controller 7 controls the interrupting mechanism 91*b* to operate so as to move (draw back) the blocking plate 90*b* to the position for smoothly supplying the toner to the developing roller 11. The interrupting mechanism 91*b* includes a drive source for moving the blocking plate 90*b* such as a solenoid or the motor 74 and an element such as a gear.

Specifically, with reference to FIG. 10, restriction of movement to the developing roller 11 by the blocking plate 90*b* is described. FIG. 10 illustrates the developing roller 11 and the magnetic roller 12 of the developing device 1, and the blocking plate 90*b* in the state of protruding in the gap between the developing roller 11 and the magnetic roller 12.

First, the blocking plate 90*b* has its longitudinal direction that is an axial direction of the developing roller 11 and the magnetic roller 12. The blocking plate 90*b* made of resin or metal having a thickness smaller than that of the gap between the developing roller 11 and the magnetic roller 12. Further, the blocking plate 90*b* is moved by the interrupting mechanism 91*b* in a white arrow direction in FIG. 10.

The blocking plate 90*b* protrudes to pass through the gap between the developing roller 11 and the magnetic roller 12. When the blocking plate 90*b* protrudes, the gap between the developing roller 11 and the magnetic roller 12 is physically interrupted. In this way, in the discharge start voltage detection mode, even if a voltage is applied to the magnetic roller 12, toner supply from the magnetic roller 12 to the developing roller 11 can be interrupted.

The interrupting mechanism 91*b* can move the blocking plate 90*b* to protrude so that the gap between the developing roller 11 and the magnetic roller 12 is interrupted by the blocking plate 90*b*. In addition, the interrupting mechanism 91*b* can also draw back the blocking plate 90*b* so that the gap between the developing roller 11 and the magnetic roller 12 is not interrupted, and that the toner can move to the developing roller 11.

In the discharge start voltage detection mode, the controller 7 controls the interrupting mechanism 91*b* to operate so as to move the blocking plate 90*b* passing through the gap between the developing roller 11 and the magnetic roller 12 to a position for preventing the toner from moving to the developing roller 11. In this way, the toner movement from the magnetic roller 12 to the developing roller 11 is interrupted by the blocking plate 90*b*. Further, the toner does not move to the developing roller 11. Therefore, the developing roller 11 (sleeve 11*c*) does not carry the toner on the circumference surface.

Further, when the discharge start voltage detection mode is finished to return to the normal mode for printing, the controller 7 controls the interrupting mechanism 91*b* to operate so as to draw back the blocking plate 90*b* from the gap between the developing roller 11 and the magnetic roller 12 and to move the blocking plate 90*b* to a position at which toner movement to the developing roller 11 is not interrupted. In this way, when printing is performed, the toner can smoothly move from the magnetic roller 12 to the developing roller 11. Then, the thin layer of the toner is formed on the sleeve 11*c* of the developing roller 11.

In this way, the developing device 1 according to this embodiment includes the developing roller 11 disposed to be opposed to the photoreceptor drum 42, so as to carry toner, the magnetic roller 12 disposed to be opposed to the developing roller 11, so as to form the magnetic brush by the carrier in the developer so that the toner in the developer is supplied to the developing roller 11 and that the toner remaining on the surface of the developing roller 11 after development is collected by the magnetic brush, the high voltage power supply 8 including the transformer 83 having the secondary side outputs one of which is connected to the developing roller 11 while the other output is connected to the magnetic roller 12, so as to apply the AC voltage to the developing roller 11 and the magnetic roller 12, the detection portion (discharge detection portion 10) for detecting occurrence of discharge between the developing roller 11 and the photoreceptor drum 42, the restriction portion 90 (the first restricting magnet 90*a* and the blocking plate 90*b*) for restricting toner movement from the magnetic roller 12 to the developing roller 11, and the moving portion 91 for moving the position of the restriction portion 90 (the rotation motor 91*a* and the interrupting mechanism 91*b*). In the discharge start voltage detection mode in which the high voltage power supply 8 changes the AC voltage to be applied to the developing roller 11 step by step so as to detect the discharge start voltage by using the detection portion, the moving portion 91 moves the restriction portion 90 so as to restrict toner movement to the developing roller 11, and draws back the restriction portion 90 when printing is performed, so that toner can move to the developing roller 11.

In this way, it is not necessary to additionally dispose a new circuit such as a circuit for adjusting voltages to be applied to the developing roller 11 and the magnetic roller 12, or a circuit for applying an additional voltage to the developing roller 11 and the magnetic roller 12 for preventing the toner movement. Therefore, it is possible to prevent the toner from being supplied (moving) from the magnetic roller 12 to the developing roller 11 in the discharge start voltage detection mode, simply and inexpensively. In addition, because the discharge start voltage (potential difference between the developing roller 11 and the photoreceptor drum 42 at which discharge starts) can be correctly detected, the AC voltage to be applied to the developing roller 11 in printing can be set to an appropriate peak-peak voltage. Therefore, image quality of the developed toner image can be improved. Further, in printing, the moving portion 91 (the rotation motor 91*a* and the interrupting mechanism 91*b*) draws back the restriction portion 90 (the first restricting magnet 90*a* and the blocking plate 90*b*), and hence the restriction portion 90 does not interrupt toner supply to the developing roller 11 in printing.

In addition, the developing device 1 according to this embodiment includes the bristle cutting roller 14 for making the thickness of the developer carried by the circumference surface of the magnetic roller 12 be constant at the position opposing to the developing roller 11. The first restricting magnet 90*a* is disposed as the restriction portion 90 in the bristle cutting roller 14. In addition, the rotating portion (rotation motor 91*a*) is disposed as the moving portion 91 for rotating the first restricting magnet 90*a*. In the discharge start voltage detection mode, the rotating portion moves the magnetic pole of the first restricting magnet 90*a* to a position opposed to the magnetic roller 12 and generates the magnetic brush by the carrier so as to prevent the toner from moving to the developing roller 11. When printing is performed, the rotating portion draws back the magnetic pole of the first restricting magnet 90*a* to a position not disposed to the magnetic roller 12 so as to cancel the state of restricting the toner movement. In this way, only in the discharge start voltage detection mode, the magnetic brush can be intentionally formed in the gap between the bristle cutting roller 14 and the magnetic roller 12. Therefore, in the discharge start voltage detection mode, it is possible to prevent the toner from attaching to the surface of the magnetic roller 12 by the magnetic brush. As a result, the toner does not move from the magnetic roller 12 to the developing roller 11 so that the developing roller 11 does not carry the toner. On the other hand, when printing is performed, the magnetic brush in the gap between the bristle cutting roller 14 and the magnetic roller 12 disappears so that the toner can be supplied (moves) from the magnetic roller 12 to the developing roller 11 without problem.

In addition, the developing device 1 according to this embodiment includes the second restricting magnet 92 disposed in the magnetic roller 12. The magnetic pole of the second restricting magnet 92 at the position opposing to the first restricting magnet 90*a* in the discharge start voltage detection mode has a polarity opposite to the magnetic pole of the first restricting magnet 90*a* at the position opposing to the magnetic roller 12. In this way, in the discharge start voltage detection mode, a strong magnetic brush can be formed between the magnetic roller 12 and the bristle cutting roller 14. Therefore, it is possible to securely prevent the toner from attaching to the surface of the magnetic roller 12 so that toner supply (movement) from the magnetic roller 12 to the developing roller 11 can be prevented. Further, it is possible to securely realize a state where the developing roller 11 does not carry the toner.

In addition, the developing device 1 according to this embodiment includes the blocking plate 90*b* as the restriction portion 90, which protrudes into the gap between the developing roller 11 and the magnetic roller 12. As the moving portion 91, there is disposed the interrupting mechanism 91*b* for extruding and drawing back the blocking plate 90*b*. In the discharge start voltage detection mode, the interrupting mechanism 91*b* extrudes the blocking plate 90*b* to pass through the gap between the developing roller 11 and the magnetic roller 12 so that the toner cannot move to the developing roller 11. When printing is performed, the interrupting mechanism 91*b* draws back the blocking plate 90*b* from the gap so as to cancel the state of restricting the toner movement. In this way, in the discharge start voltage detection mode, the extruded blocking plate 90*b* can interrupt the developing roller 11 and the magnetic roller 12. Therefore, the toner supply from the magnetic roller 12 to the developing roller 11 can be prevented, and hence the state where the developing roller 11 does not carry the toner can be realized. On the other hand, when printing is performed, because the blocking plate 90*b* is drawn back, the toner supply (movement) from the magnetic roller 12 to the developing roller 11 can be performed without a problem.

In addition, the high voltage power supply 8 applies the AC voltage to the developing roller 11 so that a potential difference between surface potentials of the developing roller 11 and the photoreceptor drum 42 in printing becomes smaller than the detected potential difference, based on the detected potential difference between the photoreceptor drum 42 and the developing roller 11 at which discharge starts. In this way, in printing, occurrence of discharge between the photoreceptor drum 42 and the developing roller 11 can be prevented.

In addition, the developing device 1 according to this embodiment includes the developing roller bias portion 84 for biasing the AC voltage to be applied to the developing roller 11 by the DC voltage. The detection portion (discharge detection portion 10) amplifies a difference between voltage values before and after change of the DC voltage applied to the developing roller 11 and outputs the amplified difference. In this way, occurrence of discharge can be correctly detected based on a variation of the DC component due to the discharge.

In addition, the high voltage power supply 8 includes the output controller 80, the transistor 81, the capacitor 82, and the transformer 83. Further, the output controller 80 supplies the control signal S1 to the base of the transistor 81 so as to switch the transistor 81. Emitter of the transistor 81 is connected to the capacitor 82. The capacitor 82 removes the DC component from the waveform obtained by amplifying the control signal S1 output from the output controller 80, and the signal from which the DC component is removed is supplied to the primary winding 831 of the transformer 83. In this way, the AC voltages to be applied to the developing roller 11 and the magnetic roller 12 can be generated and adjusted by a simple circuit.

In addition, the image forming apparatus (printer 100) according to this embodiment includes the developing device 1, which prevents the toner movement from the magnetic roller 12 to the developing roller 11 for detecting the discharge start voltage, so as to detect a correct discharge start voltage. Therefore, the image forming apparatus can apply the AC voltage to the developing roller 11, which has the peak-peak voltage as large as possible that does not cause discharge, for development. Therefore, it is possible to provide the image forming apparatus having high image quality. In addition, it is no problem to adopt an inexpensive structure in which AC voltage is applied to both the developing roller 11 and the magnetic roller 12 when the AC voltage is applied, and hence manufacturing cost of the image forming apparatus can be reduced.

Although the embodiment of the present disclosure is described above, the scope of the present disclosure is not limited to this, but can be embodied with various modifications within the scope without deviating from the spirit of the disclosure.

What is claimed is:

1. A developing device comprising:

a developing roller disposed to be opposed to a photoreceptor drum, so as to carry toner;

a magnetic roller disposed to be opposed to the developing roller, so as to form a magnetic brush by carrier in developer so that toner in the developer is supplied to the developing roller and that toner remaining on a surface of the developing roller after development is collected by the magnetic brush;

a high voltage power supply including a transformer having two or more secondary winding, one of secondary side outputs being connected to the developing roller while the other output being connected to the magnetic roller, so as to apply AC voltages to the developing roller and the magnetic roller;

a detection portion for detecting occurrence of discharge between the developing roller and the photoreceptor drum;

a restriction portion for restricting movement of toner from the magnetic roller to the developing roller; and a moving portion configured to move the restriction portion in a discharge start voltage detection mode in which the high voltage power supply changes the AC voltage to be applied to the developing roller step by step so that a discharge start voltage is detected by using the detection portion, so as to restrict the movement of toner to the developing roller, and to draw back the restriction portion so that the toner can move to the developing roller when printing is executed.

2. The developing device according to claim 1, further comprising a bristle cutting roller for making a thickness of developer carried by a circumference surface of the magnetic roller be constant at a position opposing to the developing roller, wherein a first restricting magnet is disposed as the restriction portion in the bristle cutting roller, a rotating portion for rotating the first restricting magnet is disposed as the moving portion, and the rotating portion moves a magnetic pole of the first restricting magnet to a position opposing to the magnetic roller so as to generate the magnetic brush by the carrier for preventing the toner from moving to the developing roller in the discharge start voltage detection mode, and draws back the magnetic pole of the first restricting magnet to a position not opposing to the magnetic roller so as to cancel a state in which toner movement is restricted when printing is performed.

3. The developing device according to claim 2, wherein a second restricting magnet is disposed in the magnetic roller, and a magnetic pole of the second restricting magnet at a position opposing to the first restricting magnet has a polarity opposite to the magnetic pole of the first restricting magnet at the position opposing to the magnetic roller in the discharge start voltage detection mode.

4. The developing device according to claim 1, wherein a blocking plate is disposed as the restriction portion, which protrudes into a gap between the developing roller and the magnetic roller, an interrupting mechanism is disposed as the moving portion, which extrudes and draws back the blocking plate, and the interrupting mechanism extrudes the blocking plate to pass through the gap so that the toner cannot move to the developing roller in the discharge start voltage detection mode, and draws back the blocking plate from the gap so as to cancel a state in which toner movement is restricted when printing is performed.

5. The developing device according to claim 1, wherein the high voltage power supply applies the AC voltage to the developing roller in printing so that a difference of surface potential between the developing roller and the photoreceptor drum becomes smaller than the detected potential difference between the photoreceptor drum and the developing roller at which discharge starts.

6. The developing device according to claim 1, further comprising a developing roller bias portion for biasing the AC voltage to be applied to the developing roller by a DC voltage, wherein the detection portion amplifies a difference between voltage values before and after change of the DC voltage applied to the developing roller, and outputs the amplified difference.

7. The developing device according to claim 1, wherein the high voltage power supply includes an output controller, a transistor, a capacitor, and the transformer, the output controller supplies a control signal to base of the transistor so as to switch the transistor, the transistor has an emitter connected to the capacitor, and the capacitor removes a DC component from a waveform obtained by amplifying the control signal output from the output controller, and the signal from which the DC component is removed is supplied to a primary winding of the transformer.

8. An image forming apparatus comprising a developing device according to claim 1.

9. A control method of a developing device, comprising the steps of:

causing a developing roller to carry toner, the developing roller disposed to be opposed to a photoreceptor drum;

forming a magnetic brush by carrier in developer on a magnetic roller disposed to be opposed to the developing roller;

supplying the toner in the developer to the developing roller by the magnetic brush;

collecting the toner remaining on a surface of the developing roller after development by the magnetic brush;

connecting one of secondary side outputs of the transformer having two or more secondary windings to the developing roller while connecting the other output to the magnetic roller, so as to apply AC voltages to the developing roller and the magnetic roller;

detecting occurrence of discharge between the developing roller and the photoreceptor drum;

changing a position of a restriction portion for restricting toner movement from the magnetic roller to the developing roller;

moving the restriction portion so as to restrict toner movement to the developing roller in a discharge start voltage detection mode for detecting a discharge start voltage by changing the AC voltage to be applied to the developing roller step by step; and drawing back the restriction portion so as to permit the toner to move to the developing roller when printing is performed.

10. The control method of a developing device according to claim 9, further comprising the steps of:

rotating a first restricting magnet disposed in a bristle cutting roller for making a thickness of developer carried by a circumference surface of the magnetic roller be constant at a position opposing to the developing roller;

moving a magnetic pole of the first restricting magnet to a position opposing to the magnetic roller in the discharge start voltage detection mode, so as to generate the magnetic brush by the carrier for preventing the toner from moving to the developing roller; and drawing back the magnetic pole of the first restricting magnet to a position not opposing to the magnetic roller when printing is performed, so as to cancel a state in which toner movement is restricted.

11. The control method of a developing device according to claim 10, further comprising the step of causing a magnetic pole of a second restricting magnet disposed in the magnetic roller at a position opposing to the first restricting magnet in the discharge start voltage detection mode to have a polarity opposite to the magnetic pole of the first restricting magnet.

12. The control method of a developing device according to claim 9, further comprising the steps of:

extruding and drawing back a blocking plate to protrude into a gap between the developing roller and the magnetic roller;

extruding the blocking plate to pass through the gap so that the toner cannot move to the developing roller in the discharge start voltage detection mode; and drawing back the blocking plate from the gap so as to cancel a state in which toner movement is restricted when printing is performed.

13. The control method of a developing device according to claim 9, further comprising the step of applying the AC voltage to the developing roller in printing so that a difference of surface potential between the developing roller and the photoreceptor drum becomes smaller than a detected potential difference between the photoreceptor drum and the developing roller at which discharge starts.

14. The control method of a developing device according to claim 9, further comprising the steps of:

biasing the AC voltage to be applied to the developing roller by a DC voltage; and amplifying a difference between voltage values before and after change of the DC voltage applied to the developing roller.

15. The control method of a developing device according to claim 9, wherein a control signal is supplied to base of the transistor so as to switch the transistor, emitter of the transistor is connected to a capacitor, and a signal after removing a DC component from a waveform obtained by amplifying the control signal is supplied to a primary winding of the transformer from the capacitor.

* * * * *